United States Patent [19]

Narimatsu et al.

[11] Patent Number: 4,617,604

[45] Date of Patent: Oct. 14, 1986

[54] METHOD FOR DRIVING A RELAY

[75] Inventors: Yoh Narimatsu, Koganei; Minoru Niizaki, Hachioji, both of Japan

[73] Assignee: Hewlett-Packard Company, Palo Alto, Calif.

[21] Appl. No.: 689,358

[22] Filed: Jan. 7, 1985

[30] Foreign Application Priority Data

Jan. 27, 1984 [JP] Japan ..... 59-13970

[51] Int. Cl.[4] ..... H01H 47/00

[52] U.S. Cl. ..... 361/160; 324/73 AT

[58] Field of Search ..... 361/160, 166, 167, 171, 361/189, 191; 324/73 R, 73 AT, 418

[56] References Cited

U.S. PATENT DOCUMENTS 4,348,759 9/1982 Schnurmann ..... 324/73 AT X

*Primary Examiner*—Michael L. Gellner

*Attorney, Agent, or Firm*—Douglas L. Weller; Roland I. Griffin

[57] ABSTRACT

A method which prolongs the lifetime of relays and to prevents degraded performance of relays due to oxidized film on relay contacts is presented. The method essentially comprises the alternation of relay switch operation in dry switching mode with operation in wet switching mode. The frequency and duration of operation in wet switching mode is dependent on the characteristics (e.g. construction or materials, etc.) of the relays in use.

3 Claims, 1 Drawing Figure

METHOD FOR DRIVING A RELAY

BACKGROUND OF THE INVENTION

This invention relates to a method for driving a relay and may be used in measurement instruments, particularly in integrated circuit (IC) testing apparatus. Relay matrices have been used in the prior art for IC testing apparatus and several other kinds of measurement instruments. Prior art methods for driving a relay matrix may be divided into two categories The first category, called "wet switching mode", involves switching relays within a relay matrix when the relay matrix is connected to a power source providing voltage and electric current used for measurement. The second category, called "dry switching mode", involves switching relays when the relay matrix is not connected with a power source.

During wet switching mode, application of voltage and electric current to the relay matrix may generate "sparks" by the action of opening and closing relays. These sparks may abrade relay contacts and thereby shorten the lifetime of the relays. During dry switching mode, on the other hand no power source is connected; therefore, no sparks are generated and the attendant abrading of relay contacts does not occur. Accordingly to our experimental data, the lifetime of relays using dry switching mode was greater than the lifetime of relays in wet switching mode by an amount on the order of 100 times. However, in dry switching mode, extraneous substances and oxidized film can be formed at relay contacts which may increase contact resistance thereby increasing inaccuracy in measurement.

SUMMARY OF THE INVENTION

The principal purpose of this invention is to maintain a long lifetime for relays and to prevent degraded performance due to oxidized film on relay contacts. This is done by alternating operation in dry switching mode with operation in wet switching mode. The frequency and duration of operation in wet switching mode is dependent on the characteristics (e.g. construction or materials, etc.) of the relays in use. For any given relay, the amount of operation in wet switching mode should be sufficient to remove oxidized film and other unexpected extraneous substances by spark but should be minimized in order to prevent abrasion at the relay contacts For instance, dry switching mode may be used during general measurement, and then wet switching mode may be used for a shorter period.

In IC testing apparatus a relay matrix may be operated in wet switching mode when the IC testing apparatus is initially turned on, before measuring IC characteristics, or during performance of tests of the relay matrix. In this way, oxidized film or other extraneous substances at the relay contact can be removed. After operating in wet switching mode operation, dry switching mode may be used for measurement of IC characteristics or for performance tests of the relay matrix. In this way the build up of amounts of contact resistance at relay contact may be avoided thus resulting in accurate measurements and tests. In IC testing apparatus, operation in wet switching mode a few times per day is sufficient to prevent build up of extraneous substance while it insures an extended life of contact relays by alleviating abrasion of relay contacts.

DESCRIPTION OF THE PREFERRED EMBODIMENT

Figure 1:
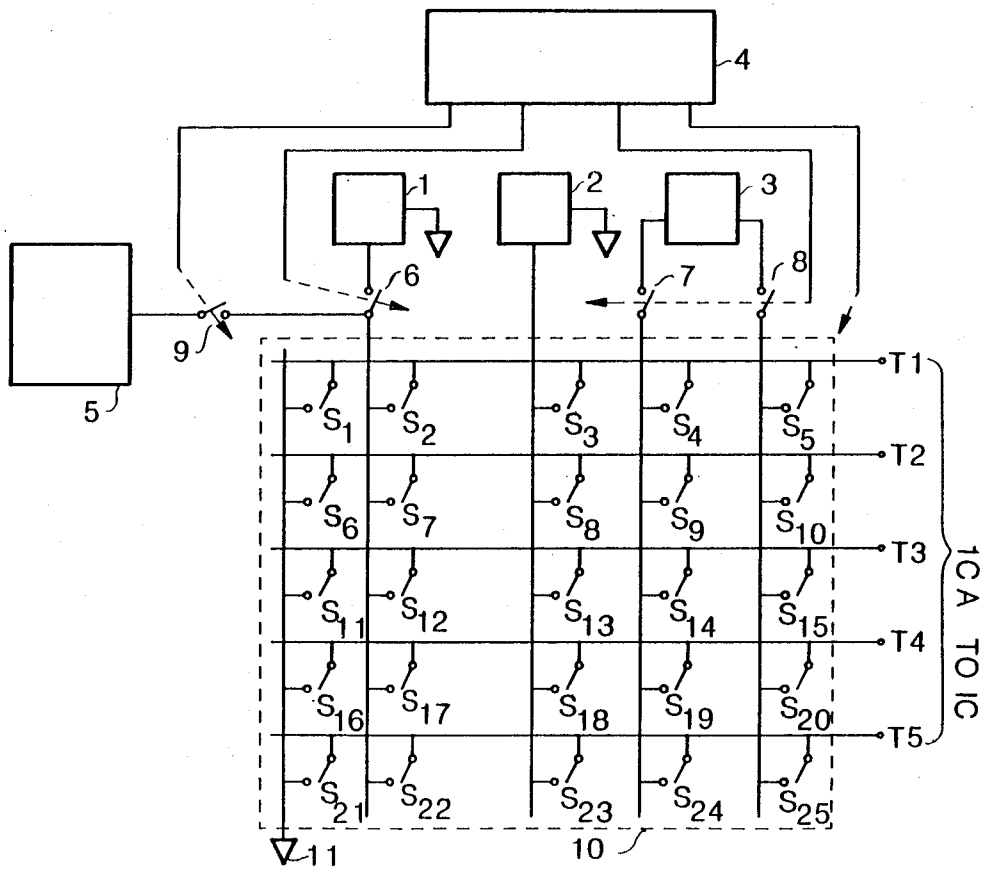
FIG. 1 a block diagram of an integrated circuit (IC) testing apparatus in accordance with the preferred embodiment of the present invention.

FIG. 1 is a block diagram of an IC testing apparatus possessing a relay matrix which is operated in accordance with the concept of this invention. A relay matrix 10 comprising relay switches S1–S25 is connected with a voltmeter 2 and terminal switches 6,7,8,9. The other side of switch 6 is connected to a DC power source 1. Switches 7 and 8 are connected to an ampmeter 3. Switch 9 is connected to a detector 5 which comprises a second DC power source and a comparator. Terminals T1–T5 of relay matrix 10 are connected to terminals of an integrated circuit (IC) (not shown). Switches 6–9 and relay switches S1–S25 are controlled (opened and closed) by a control circuit 4.

The following describes a sequence for driving relay matrix 10 in wet switching mode prior to measurement of IC characteristics and then driving relay matrix 10 in dry switching mode during measurement of IC characteristics.

First, operations in wet switching mode may be performed as follows Initially, switches 6–9 and relay switches S1–S25 are open. Switch 9 is then closed by control circuit 4. This provides electric current from the second DC power source (located in detector 5) to relay matrix 10. Then Control circuit 4 opens and closes switches so that current flows through them at the time they are closed. For instance, relay switches S1 and S2 may be closed permitting DC current to flow from detector 5 through relay switches S2 and S1 and to a node 11 at the reference voltage. In the same way, relay switch S1 may be opened and relay switches S2, S5, S25 and S21 may be closed thereby causing a current to flow from detector 5 through relay switches S2, S5, S25, 21 to node 11. In the same way, control circuit 4 opens and closes other series of relay switches from relay switches S1–S25 to complete a circuit from detector 5 to node 11. Control circuit 4 may contain a program to insure each switch is operated in wet mode a prescribed amount of time. When wet mode operation is completed, switch 9 and relay switches S1–S25 are opened.

Measurement of IC characteristics may then proceed with operation in dry switching mode. For instance, measurement of voltage and electric current between terminals T1 and T2 may be performed as follows. First, relay switches S5, S6, S12, S13, and S14, and switches 7,8 are closed. Then, switch 6 is closed coupling DC power source 1 to matrix 10. Initially, DC power source 1 is at 0 volts. Once switch 6 has been closed, however, DC power source 1 is set to an appropriate voltage value. The electric current from DC power source 1 flows through switch 6, relay switches S12, S14, switch 7, ampmeter 3, switch 8, relay switch S5, terminal T1, the IC, terminal T2, and relay switch S6 to the reference voltage. The voltmeter 2 is connected to terminal T1 by closing relay switch S3. The voltage and electric current between terminal T1 and T2 are measured; furthermore, IC characteristics resulting from the DC current can be obtained from the measurement value of voltmeter 1 and ampmeter 3.

If it is then desired to take a measurement between terminals T3 and T4, output voltage of DC power source 1 is resettled at OV, and then switch 6 is opened. Then appropriate relay switches are closed out of relay switches S1–S25 in order to connect terminals T3 and T4 to measurement devices. Switch 6 is then closed, DC power source 1 is set to an appropriate voltage value and the measurement can be performed. When the measurement is completed, DC power source 1 is resettled to 0 volts and switch 6 is opened.

A performance test for relay matrix 10 may be conducted in order, for instance, to ascertain the conductivity through each relay switch of switches S1–S25. Prior to the performance test wet switching mode operation of relay matrix 10 should be performed as described above. After operation in wet switching mode, switch 9 and all relay switches S1–S25 are opened.

In order to carry out the performance test, selected relay switches should be closed out of relay switches S1–S25, then switch 9 should be closed. By comparing DC current to DC voltage through the selected closed relay switches, resistance through the selected switches may be calculated. Switch 9 may then be opened and other relay switches selected, until it can be determined what is the resistance through each relay switch S1–S25. Selection of the switches may be done automatically through a program stored in control circuit 4.

We claim:

1. A method for driving a relay comprising the steps of, driving the relay in dry switching mode for general measurement, driving the relay intermittently in wet switching mode in order to clean relay contact areas.

2. A method as in claim 1 wherein the wet switching mode step is executed before dry switching mode step.

3. A method as in claim 2 wherein the wet switching mode step is executed at system start-up time.

* * * * *